United States Patent [19]

Kaneko et al.

[11] Patent Number: 4,632,173

[45] Date of Patent: Dec. 30, 1986

[54] LABOR SAVING APPARATUS FOR CONTINUOUS CASTING FACILITY

[75] Inventors: Hideo Kaneko, Kobe; Akira Murata, Kakogawa; Eiji Inoue, Motoyamaminami; Satoshi Satoh, Kobe; Shinji Shiraishi; Shoichi Hiwasa, both of Kurashiki, all of Japan

[73] Assignees: Kawasaki Jukogyo Kabushiki Kaisha; Kawasaki Steel Corporation, both of Kobe, Japan

[21] Appl. No.: 706,692

[22] Filed: Feb. 28, 1985

[51] Int. Cl.[4] ..... B22D 11/10

[52] U.S. Cl. ..... 164/417; 164/420; 164/437; 164/438; 164/473

[58] Field of Search ..... 164/270.1, 337, 412, 164/417, 420, 437, 438, 439, 473, 488, 489; 222/591

[56] References Cited

U.S. PATENT DOCUMENTS

| | | | |
|---|---|---|---|
| 3,273,208 | 9/1966 | Greenberger | 164/420 |
| 3,344,847 | 10/1967 | Beemer | 164/420 |
| 3,620,285 | 11/1971 | Olsson | 164/412 |
| 3,970,135 | 7/1976 | Schmid et al. | 164/452 |
| 4,194,555 | 3/1980 | Schrewe | 164/438 |
| 4,391,319 | 7/1983 | Heaslip et al. | 164/259 |
| 4,502,527 | 3/1985 | Brewer | 164/412 |

FOREIGN PATENT DOCUMENTS

| | | | |
|---|---|---|---|
| 0011650 | 6/1980 | European Pat. Off. . | |
| 2653306 | 10/1977 | Fed. Rep. of Germany . | |
| 2849972 | 5/1979 | Fed. Rep. of Germany | 164/438 |
| 2407773 | 7/1979 | France | 164/473 |
| 52-65723 | 5/1977 | Japan | 164/473 |
| 57-44429 | 9/1982 | Japan . | |
| 58-6606 | 2/1983 | Japan . | |
| 57-42591 | 2/1983 | Japan . | |

*Primary Examiner*—Nicholas P. Godici
*Assistant Examiner*—Richard K. Seidel
*Attorney, Agent, or Firm*—Armstrong, Nikaido, Marmelstein & Kubovcik

[57] ABSTRACT

Continuous casting facilities generally including a pair of moulds with a rail on each side thereof. Self-propelled tundish cars each carrying a tundish with a detachable immersion nozzle ride on the rails. The apparatus includes a truck running on the rail opposite the operator's side of the moulds connectable with one of the tundish cars and carrying an immersion nozzle exchanger. A connecting piece feeder, a powder feeder, and an immersion nozzle preheater are also mountable on the truck. Equipment interferences are eliminated by the specific structures and the operator's view of the moulds is not obstructed.

10 Claims, 24 Drawing Figures

LABOR SAVING APPARATUS FOR CONTINUOUS CASTING FACILITY

BACKGROUND OF THE INVENTION

This invention relates to a labour-saving apparatus for mechanizing, rationalizing and improving in efficiency a series of operations for pouring molten steel through a sliding nozzle at the bottom of a tundish into a mould at a continuous casting facility for sequentially casting.

In general, such operations are conducted not only during the pouring of molten steel but also before and after pouring. Main operations include the exchanging of old for new immersion nozzles following the exhaustion of the immersion nozzle which is connected to the lower end of the sliding nozzle and immersed in the mould, the feeding of a connecting piece into the mould to switchover to a different type or grade of molten steel for the next continuous casting and the feeding of powder for prevention of oxidation of the surface of the molten steel in the mould and for lubrication thereof.

A variety of contrivances have been attempted to eliminate manual operations by mechanizing these operations, however, satisfactory results have not been attained yet.

For instance, the arrangement of the nozzle exchanger described in the Japanese Utility Model Publication No. 58-6606 is dangerous since its operation device runs about over the narrow operation floor, and further more, positioning of the operation device at the sliding nozzle is difficult. Accordingly, it takes a long time to exchange the immersion nozzle. Furthermore, each operation device requires an operator exclusively appointed to its operation.

In the arrangement of the nozzle exchanger described in the Japanese Patent Publication No. 57-44429, all of the tundishes are provided with an exchanger. The exchange operation, therefore, can be made in a relatively short period of time. It has, however, other demerits such as high cost and the necessity to preheat the immersion nozzle to a specified temperature before exchanging the immersion nozzle.

In the arrangement of the connecting piece feeder described in the Japanese Utility Model Publication No. 57-42591, because the immersion nozzle was pierced into the connecting piece, the length of the immersion nozzle has been extra-long. As a result, there were many problems; for example, it was hard to prevent the feeding of powder from interfering with other functions. Additionally, the immersion nozzle could not be replaced until a connecting piece was placed in the mould.

Further, accoding to the above-mentioned prior art, when a variety of operations are to be made on the molten steel pouring operation floor, it is inevitable that some control elements and rotating operation arms are positioned on the operators' side of the overall apparatus to avoid mutual interferences. Such operations on the operators' side of the apparatus are extremely dangerous, and have a fatal defect in the operational aspect that the operators' view of the placement of a connecting piece is hindered.

OBJECTS AND SUMMARY OF THE INVENTION

It is an object of the present invention to solve the above-mentioned problems by automating the conventional manual operations by bringing all of the devices indispensable to continuous casting to the counter-operator side, thus assuring operators' safety.

It is also an object of the present invention to secure the direct view of the placement of a connecting piece for the operator by operating all devices on the counter-operator side of the center line of the mould.

It is a further object of the invention to reduce the number of required operators and allow new installation of such devices to existing tundish cars by installing the devices together on a truck which follows a tundish car.

It is a summary of the present invention to mount an immersion nozzle exchanger, and/or a connecting piece feeder or powder feeder on a truck on the counter-operator side. The truck is movable together with a tundish car. Further, each device on the truck is retracted to a specified position, while it is idle, so as not to hinder the operation of other devices.

BRIEF DESCRIPTION OF THE DRAWINGS

A preferred embodiment of the present invention will be explained below with reference to the accompanying drawings, wherein.

DETAILED DESCRIPTION OF PREFERRED EMBODIMENTS

Figure 1:
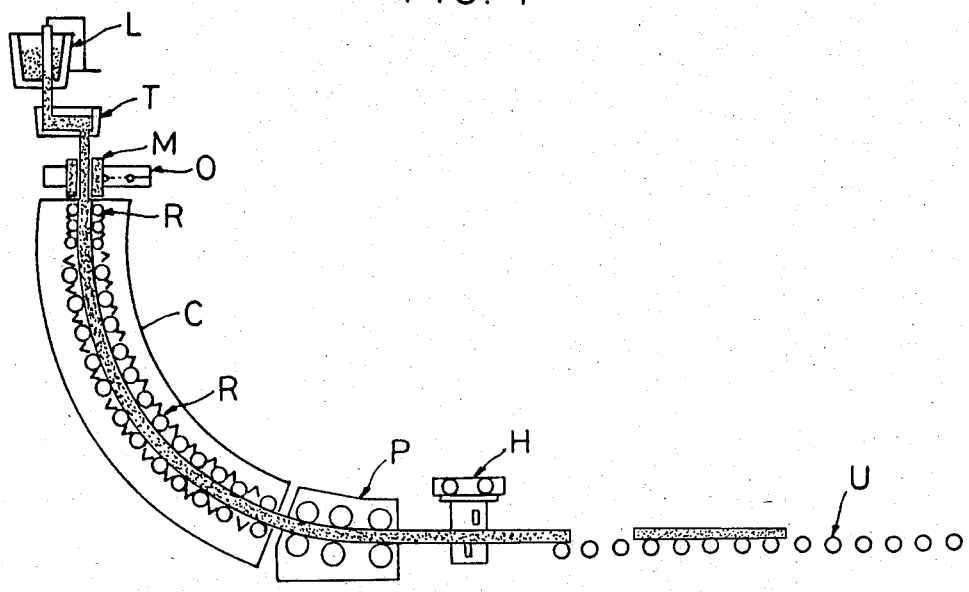
FIG. 1 is an overall schematic view of a prior art continuous casting facility.

First, the outline of a prior art continuous casting facility will be explained with reference to FIG. 1. L stands for a ladle, T for a tundish, M for a mould, O for a mould oscillating unit, C for a colling chamber, R for a roller apron, P for a pinch roller straightener, H for a shear, and U for a runout roller table.

Molten steel is poured through a nozzle in the bottom of the tundish T into the oscillating water-cooled mould M. A slab with its surface solidifying is withdrawn from the bottom of the mould M and guided through the roller apron R and cooling chamber C consisting of guide rollers and a cooling water jet unit. The slab solidifying in the cooling chamber C is continuously withdrawn by the pinch rollers P and cut into pieces of required length by the shear H. The cut pieces are then carried out by a runout roller table U.

Figure 2:
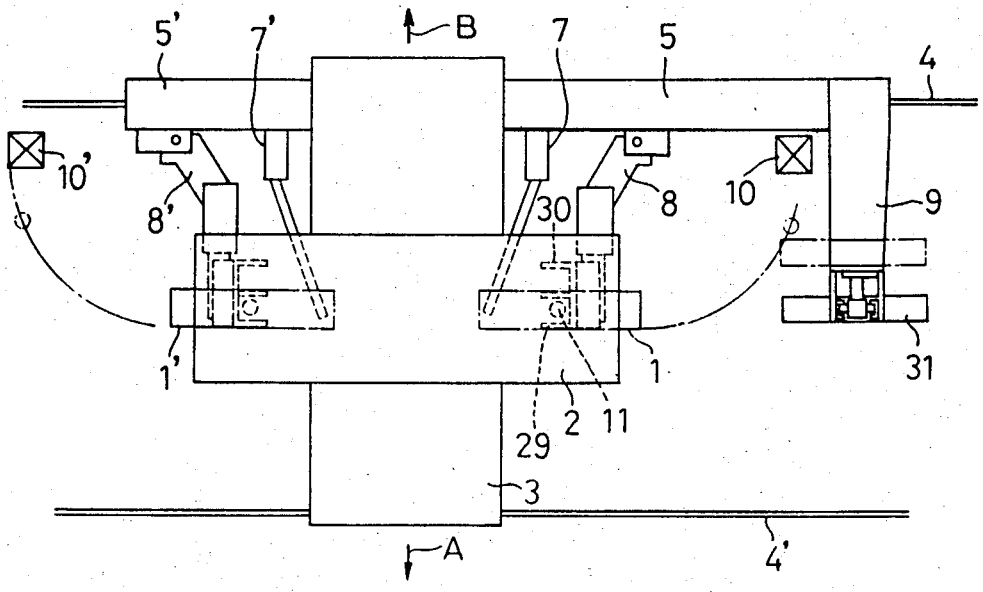
FIG. 2 is a plan view of an embodiment of labour-saving apparatus of the present invention.

In FIG. 2, the continuous casting facility as shown in the figure is a two-strand type in which two slab moulds 1 and 1′ are arranged side by side. In the following, the explanation is centered around the mould 1. Items related to the other mould 1′ are provided symmetrically positioned and, where appropriate, are identified with a prime.

A tundish car 3 is mounted on rails 4 laid on both sides of moulds 1 and 1′, and is moved transversely by a driving unit (not shown). On the tundish car 3, is mounted a tundish 2 which can pour molten steel into two moulds 1 and 1′ simultaneously.

The visible side of FIG. 2 is the operator side A, and the opposite side is the counter-operator side B.

On the rail 4 of the counter-operator side B, trucks 5 and 5′ and mounted by means of wheels 6 (see FIGS. 3 and 4), and are connected to the tundish car 3 so as to follow the tundish car 3.

On the trucks 5 and 5′, immersion nozzle exchangers 8 and 8′ and powder feeders 7 and 7′, respectively corresponding to the mould 1 and 1′, are mounted. A connecting piece feeder 9 is mounted on one truck 5. Nozzle heaters 10 and 10′ are provided for the immersion nozzle exchangers 8 and 8′.

Figure 3:
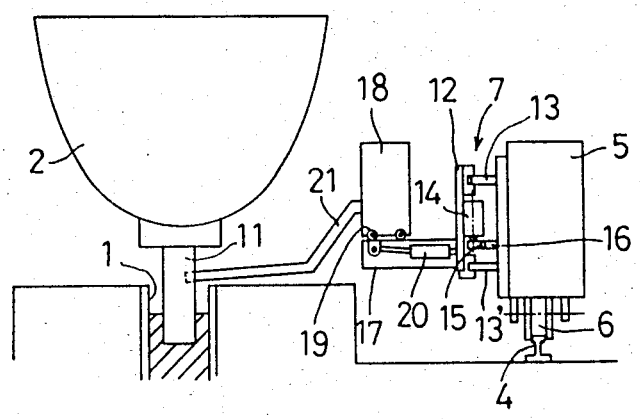
FIG. 3 is a side view of a powder feeder at the time of molten steel pouring.

FIG. 3 shows the condition during pouring of molten steel from the tundish 2 through an immersion nozzle 11 immersed in the molten steel and the condition of the related powder feeder 7. In the same figure, a fram 12 of the powder feeder 7 is mounted on the traversing rails 13 and 13′ installed in the upper and lower parts of the side of the truck 5 on the operator side A. A pinion 15 of a traversing motor 14 mounted on the fram 12 engages with a rack 16 of the truck 5 to traverse the powder feeder 7.

Figure 5:
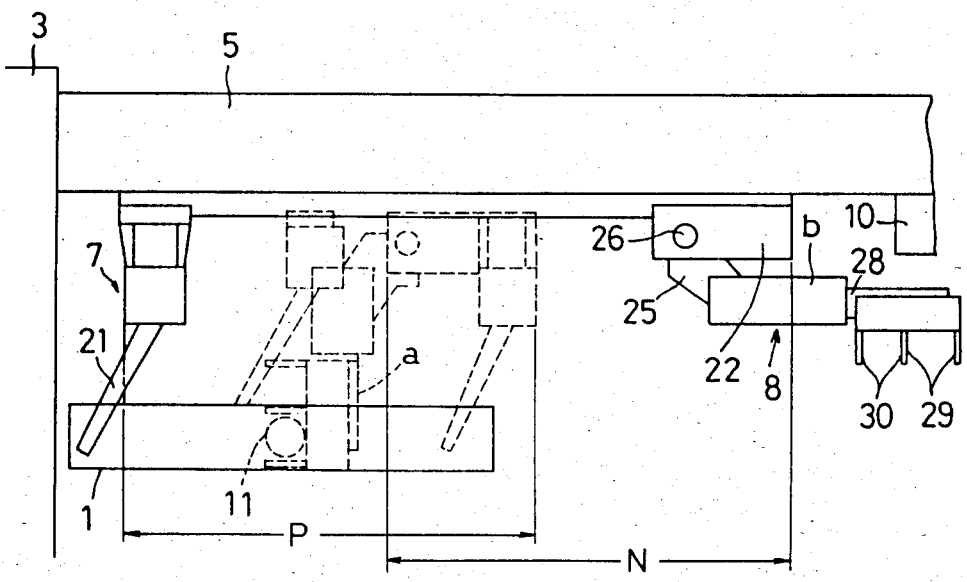
FIG. 5 is a partial plan view showing the operation and interconnection of the powder feeder and the immersion nozzle exchanger.

On a horizontal extension 17 of the frame 12, a powder feed tank 18 is movable placed by means of wheels 19, and is connected to a cylinder 20 to be moved forward and backward. A powder feed duct 21 extends from the powder feed tank 18 to the mould 1. As shown in FIG. 5, powder is fed across the whole width of the mould 1 from the top end of the duct 21 by traversing the frame 12. At the locations where the powder feed duct 21 will interfere with the immersion nozzle 11, the powder feed tank 18 and the powder feed duct 21 are retracted by the cylinder 20 to avoid the interference. In FIG. 5, P indicates the movable range of the powder feeder 7.

Figure 4:
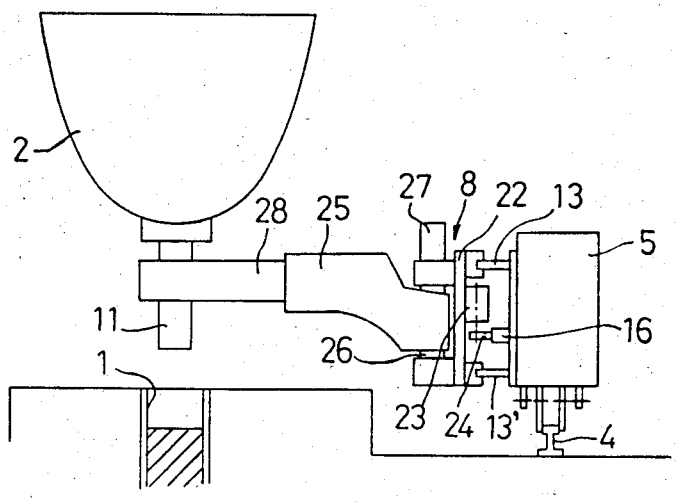
FIG. 4 is a side view of an immersion nozzle exchanger with the immersion nozzle raised from the mould.

FIG. 4 shows the immersion nozzle 11 in the raised position from the mould 1 and the related immersion nozzle exchanger 8. In the same figure, the carriage 22 of the immersion nozzle exchange 8 uses the same traversing rails 13 and 13′ as the powder feeder 7. That is, the exchanger 8 is mounted on the same traversing rails 13 and 13′. A pinion 24 of the traversing motor 23 fixed on the carriage 22 engages the rack 16 to move the carriage transversely. Further, an immersion nozzle exchange arm 25 is pivoted for horizontal rotation at its base end by a vertical support axle 26 mounted on the carriage 22. The arm 25 rotates and traverses between the exchange operation position a indicated by a dotted line and the retracted position b indicated by a solid line in FIG. 5 by means of a rotating motor 27 and the traversing motor 23. The retracted position is the limit position of the counterclockwise rotation of the arm 25.

The immersion nozzle exchange arm 25 is expansively arranged and has a hand section 28 provided with a nozzle hanger 29 for a new immersion nozzle and a nozzle hanger 30 for an old (spent) immersion nozzle. Each hanger is provided with an exchange operation motor (shown in FIG. 6, but not illustrated in detail).

A new immersion nozzle 11 is preheated by the nozzle heater 10 and transferred to the nozzle hanger 29 in the retracted position by a short distance conveyer (not illustrated). After that, the immersion nozzle exchanger 8 positions the nozzle hanger 30, by the traversing of the carriage 22, and clockwise rotation and expansion of the arm 25, over to the old immersion nozzle 11′ mounted on the tundish 2 via the means 11 for detachably mounting the immersion nozzle (sliding nozzle 16) and receives the old immersion nozzle 11′ on the nozzle hanger 30.

Next, the new immersion nozzle 11 is then positioned in the mounted position, and mounted on the sliding nozzle 16 on the tundish 2. The immersion nozzle exchanger 8 is then operated in the reverse order of the above-mentioned steps, to restore the arm 25 in the retracted position b and discharge the old immersion nozzle 11′. N in FIG. 5 shows the movable range of the immersion nozzle exchanger 8. This movable range N partially overlaps the movable range P of the powder feeder 7. However, during the feeding of powder while casting, the immersion nozzle exchanger 8 can be retracted to the position b (solid lines) in FIG. 5 to avoid any interference resulting from the common use of the traversing rails 13.

With reference to FIG. 6 through FIG. 16, other features of the immersion nozzle exchanger will be explained below specifically.

Figure 6:
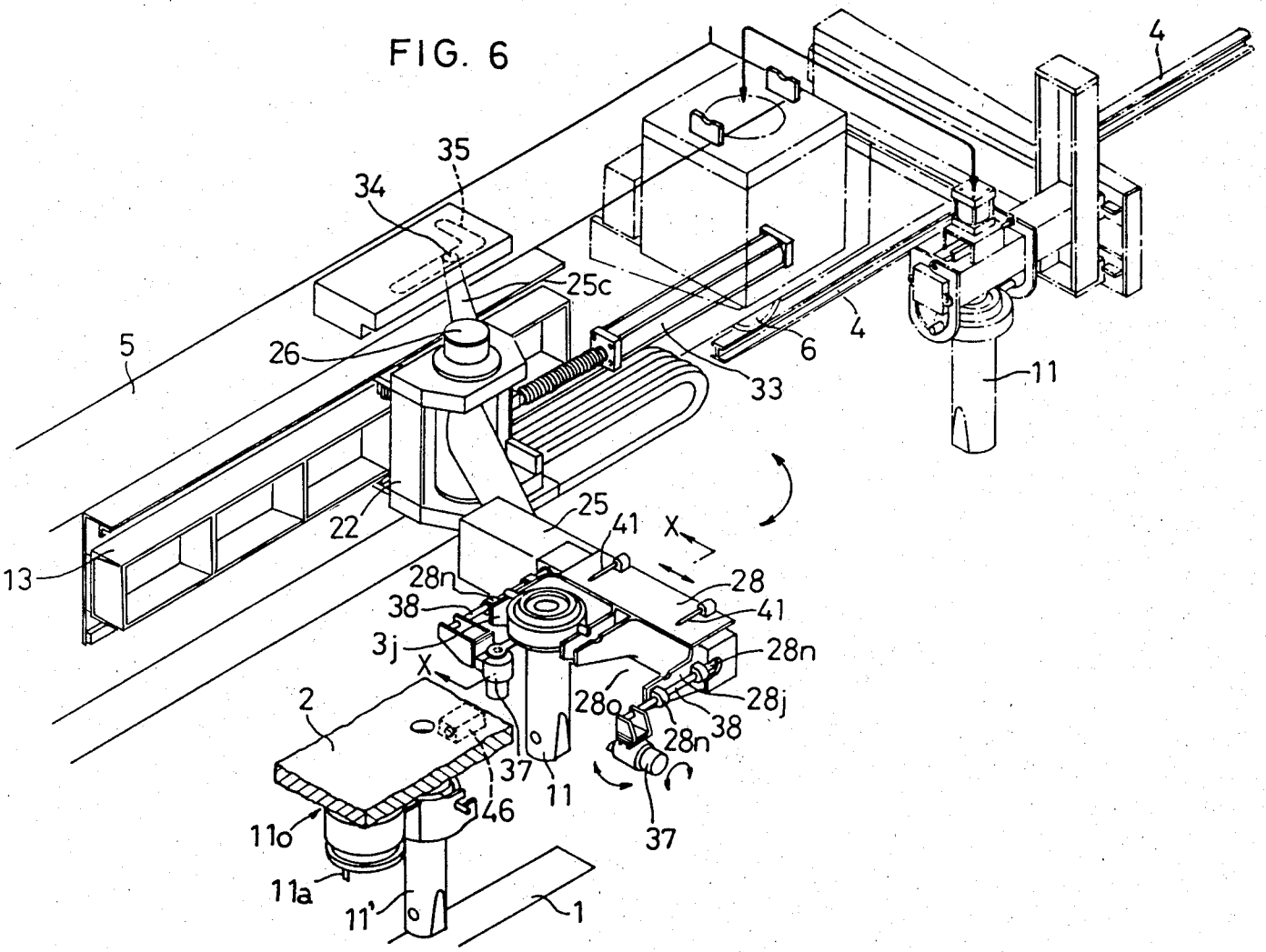
FIG. 6 is an overall perspective view of another embodiment of an immersion nozzle exchanger.
Figure 9:
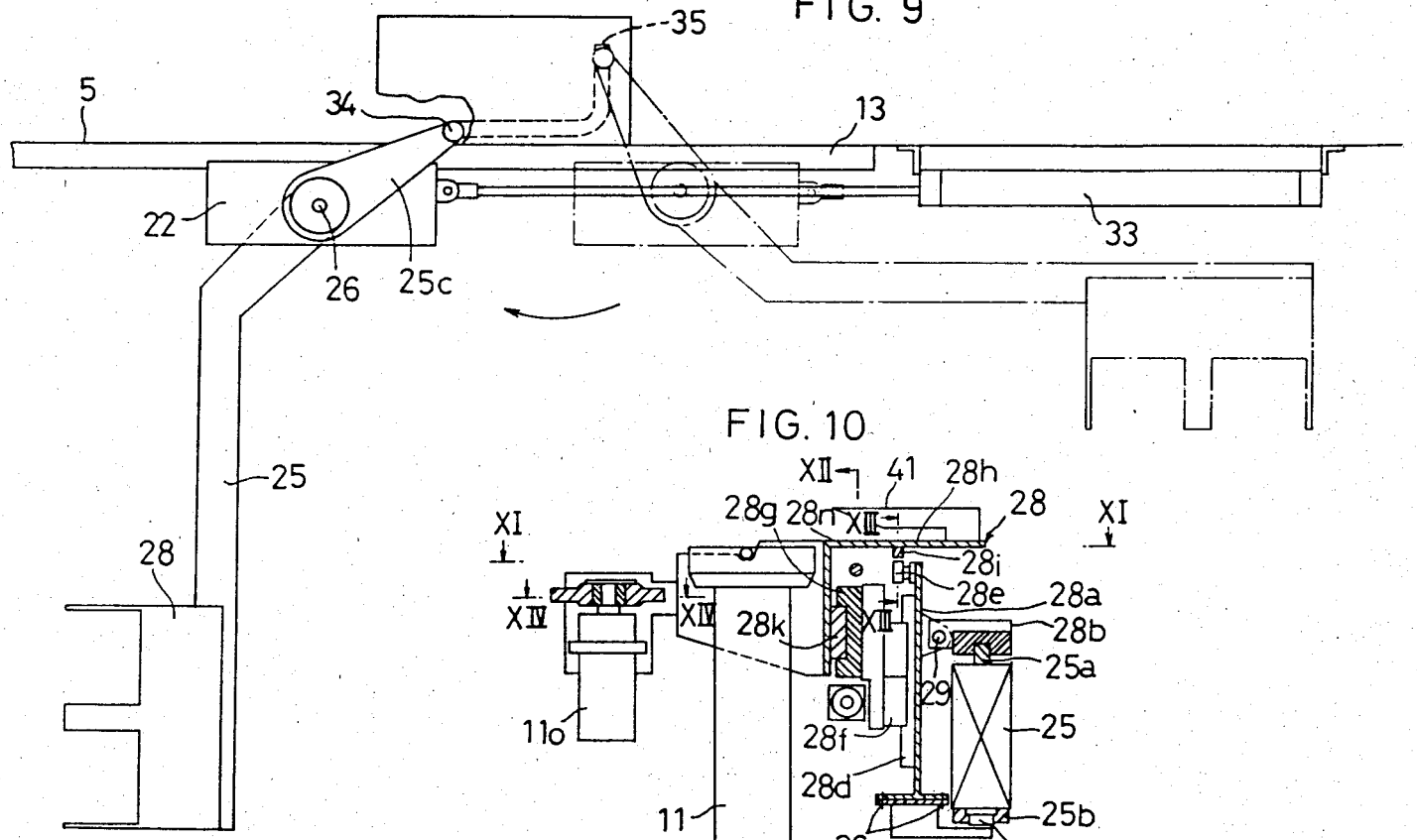
FIG. 9 is a plan view showing the rotation mechanism of the arm of FIG. 6.

In FIG. 6, the flat and straight (in the specification, the shape of this means is straight viewing from right above) truck 5 is arranged to travel on the rail 4 by means of the wheels 6 mounted on the bottom of the truck. A carriage 22 is movably mounted on a traversing rail 13 fixed on the truck 5. The movement of the carriage is effected by the stroke of a cylinder 33 connected to both carriage 22 and truck 5. As shown in FIGS. 6 and 9, the carriage 22 supports an arm 25 having a hand section 28 at the arm's top end in such a way that the arm can rotate freely about a support axle 26. To restrain the movement of the arm, a lever 25*c* is integrally formed on the arm 25 above the support axle. The top end of the formed lever 25*c* is provided with a rotatably mounted guide roller 34. A guide groove 35 is formed on the truck 5 to guide the guide roller 34. The guide groove 35 is of flat L shape as shown in FIGS. 6 and 9. The arm 25 is arranged to be rotated through about 90 degrees relative to the truck 5 when the carriage 22 (and arm 25) travels along the traversing rail 13.

Figure 10:
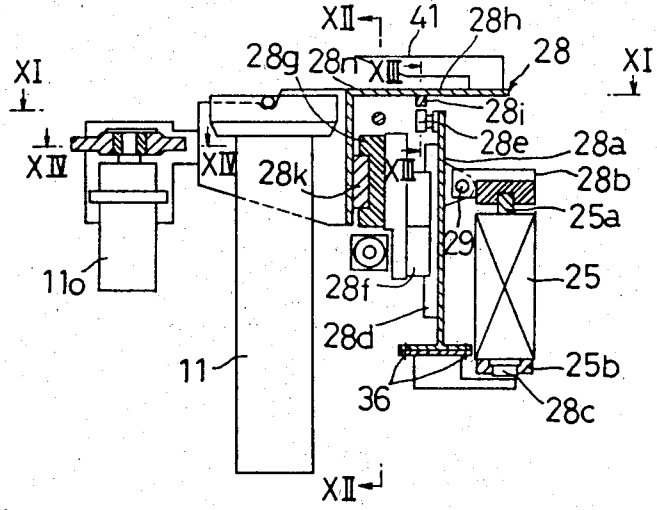
FIG. 10 is a flat view taken in the direction of the arrows along the line X—X of FIG. 6 and shows the hand section at the top end of the arm.

As shown in FIG. 10, on the top of the arm 25, a transverse rail 25*a* of rectangular cross section is formed. On the bottom of the arm, a guide groove 25*b* of inverted convex cross section is formed. The hand section 28, as shown in FIG. 10, includes a slider section 28*b* which engages with the traverse rail 25*a* of the arm and is connected by pins 29 to the upper portion of one side of the main frame 28*a*. In the lower portion, the main frame 28*a* extends towards the bottom of the arm, and a roller 28*c* which is fitted in the guide groove 25*b* in the lower face of the arm is rotatably mounted on this extended portion. The hand section 28 is thus mounted on the traverse rail 25*a* formed on the top of said arm 25, and the roller 28*c* of the hand section 28 is slidably fitted in the guide groove 25*b* formed in the lower face of said arm 25; the hand section 28 is thus arranged to be movable in the axial direction of the arm 25. In the main frame 28*a* of said hand section 28, the lower portion supporting the roller and the upper portion are fixed together with bolts and nuts 36 (indicated by center lines in the figure). This arrangement allows fine adjustment in the transverse direction around the pin 29 of FIG. 10. In other words, even if the hand section is inclined, the arrangement allows restoration of the hand section to the proper position by loosening the bolts and nuts 36, moving the hanger section to the proper position, and retightening the bolts and nuts.

Figure 11:
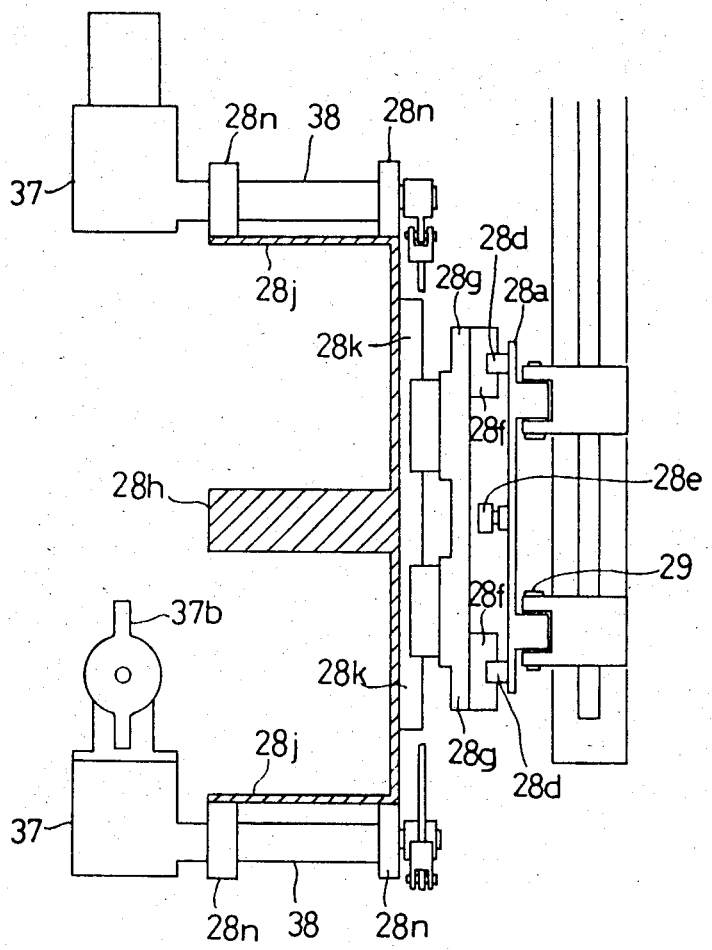
FIG. 11 is a plan view taken in the direction of the arrows along the line XI—XI of FIG. 10 and shows the hand section.

As shown in FIGS. 10 and 11, vertical rails 28*d* are formed on both edges of the left side of main frame 28*a* of the hand section. Sliders 28*f* slidably engage the vertical rails 28*d*. The sliders 28*f* are fixed to a block 28*g* having a traverse guide groove on one side. The traverse guide groove of the block 28*g* slidably engages a traverse rail 28*k* which is formed on one side of the hanger section 28*h*.

Accordingly, the hanger section 28 is arranged to have two degrees of freedom relative to the main frame 28*a*, namely, in the vertical direction and in the axial direction of the arm 25.

Figure 12:
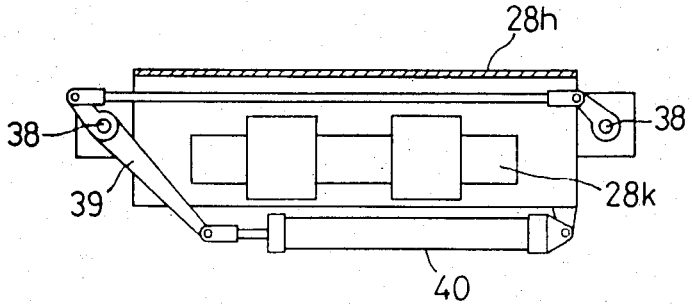
FIG. 12 is a view taken in the direction of the arrows along the line XII—XII of FIG. 10 and shows a linkage for driving rotating shafts, each of which is provided with a mounting/dismounting motor.
Figure 13:
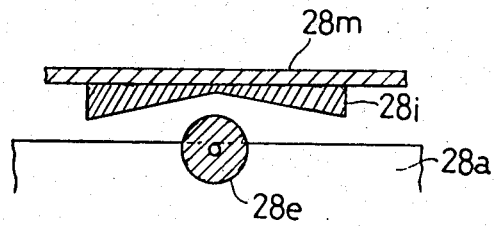
FIG. 13 is a side view taken in the direction of the arrows along the line XIII—XIII of FIG. 10 and shows the main portion of an automatic center aligning mechanism.

As shown in FIG. 10, on the lower face of the top plate 28*m* of the hanger section 28*h*, an inclined guide 28*i* (see FIG. 13) is mounted. The guide 28*i* rests on a guide roller 28*e* formed on the center top of the main frame 28*a* to constitute a self-aligning system. Further, as shown in FIGS. 6 and 11, supporting fixtures 28*n* which receive the nozzle 11 are formed on the sides of the loading plate 28*j* of the hanger section 28*h*. The supporting fixtures 28*n* rotatably support rotatable shafts 28 having ends provided with nozzle mounting/dismounting motors 37. The rotatable shafts 38, as shown in FIG. 12, are arranged to be rotated by a cylinder 40 on the arm side of the vertical plate of the hanger section 28*h* by means of a linkage 39.

Figure 14:
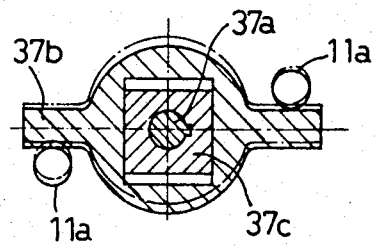
FIG. 14 is a sectional view taken in the direction of the arrows along the line XIV—XIV of FIG. 10 and shows the mounting structure of the rotating shaft of the mounting/dismounting motor and the propeller.

As for the nozzle mounting/dismounting motors 37, as shown in FIG. 14, a propeller 37*b* for engagement is fixed to each rotating shaft 37*a* of the mounting/dismounting motor by means of a slider 37*c*; each propeller 37*b* is so arranged that it can reciprocate in the direction perpendicular to the rotating shaft 37*a*. This allows automatic and proper engagement even if there is some positioning error between the nozzle mounting/dismounting motor 37 and the engaging pawl 11*a* of the sliding nozzle (condition relative to the engaging pawl indicated by a broken line in FIG. 14). As shown in FIGS. 6 and 10, guide pins 41, which fit into a positioning guide 46 formed on the sliding nozzle side, are fixed to the upper face of the top plate 28*m* of the hanger section 28*h*.

The present nozzle exchanger 8 of the above-mentioned arrangement operates in the following manner during the change of nozzles.

With the extension of the cylinder 33, the arm 25, which is initially maintained roughly in parallel with the truck 5, shifts together with the carriage 22 towards the tundish (sliding nozzle 11*o*) along the guide rail 13 traversing the truck. With such a shift, the arm 25 gradually rotates from a position close to the side of the truck towards the tundish. This rotation of the arm 25 is effected by the restraint of the guide roller 34 of the arm 25 by the guide groove 35 of the truck. After having rotated through about 90 degrees relative to the truck 5, the arm 25 maintains its relative position and approaches the sliding nozzle 11*o* on the tundish. The hand section 28 then moves on the arm so that an empty nozzle loading space 28*o* of the hand section 28 mounted on the top end of the arm comes to a position in front of an immersion nozzle 11 beneath said sliding nozzle 11*o*.

Figure 7:
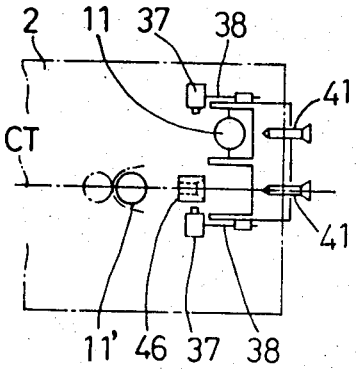
FIG. 7 is a schematic plan view showing the positioning of the apparatus just prior to the removal of an old immersion nozzle.
Figure 8:
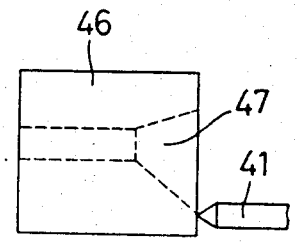
FIG. 8 is a schematic side view showing the positioning just prior to fitting of a guide pin into a positioning guide.

With the above-mentioned relative condition being kept unchanged, the carriage 22 moves towards the tundish, and the guide pin 41 of the hanger section 28*h* (hand section 28) fits into the positioning guide 46 fixed on the center line CT of the bottom of the tundish as shown in FIG. 7. The loading space 28*o* of the hanger section is thus exactly positioned for the old immersion nozzle. During this operation, because the hanger section 28*h* is supported by the inclined guide 28*i* and the roller 28*e* on the main frame 28*a* side, the hanger section can be moved, following the guide of said guide pin 41, in the upward direction and the axial direction of the arm. As the guide hole 47 of the positioning guide 46 has a large approach ramp in the lower portion, as shown in FIG. 8, the hanger section 28*h* always is lifted to some extent, and the exact positioning can be made.

By the operation of the cylinder 40, the rotating shafts 38 on which the mounting/dismounting motors 37 are mounted are rotated to engage the propellers 37*b* of the mounting/dismounting motors with the engaging pawls 11*a* on the sliding nozzle. During this engagement, some positional mismatch does not prevent correct engagement of the engaging pawls 11*a* and the propellers 37*b* since the propellers 37*b* are mounted on the rotating shafts 37*a* of the mounting/dismounting motors 37 via sliders 37*c* so that the propellers can reciprocate as explained above. Next, the mounting/dismounting motors 37 revolve in engagement with the engaging pawls 11*a* to release the engagement of the sliding nozzle 11*o* and the old immersion nozzle 11', and load the old immersion nozzle 11' on the loading plate 28*j*. The rotating shafts 38 then revolve to release the engagement of the engaging pawls 11*a* with the propellers 37*b*. With the backward movement of the carriage 22, the hanger section 28*h* retreats away from the sliding nozzle 11*o*. In the operation, the guide pin 41 is released from the positioning guide, and by the action of the inclined guide 28*i*, the hanger section 28*h* is restored to the specified position.

Next, the hand section 28 is moved on the arm 25 so that the new immersion nozzle 11 comes to a position beneath the sliding nozzle and the hand section 28 is moved forward to the sliding nozzle 11*o* by the advancing carriage 22. When the new immersion nozzle 11 is placed beneath the sliding nozzle 11*o*, the guide pin 41 of the hand section fits into the positioning guide 46 on the tundish, and the lower face of the sliding nozzle 11*o* and the top of the new immersion nozzle are aligned with each other. Under this condition, the cylinder 40 operates and rotates the rotating shafts 38 to engage the propellers 37*b* of the mounting/dismounting motors 37 with the engaging pawls 11*a* on the sliding nozzle side. The mounting/dismounting motors 37 then revolve to complete the joining of the sliding nozzle 11*o* and the new immersion nozzle 11. After that, with steps of procedure similar to those of the above-mentioned retreat of the old immersion nozzle 11', the hand section 28 retreats, and the cylinder 33 retracts to rotate and restore the arm 25 to the original standby position.

Figure 15:
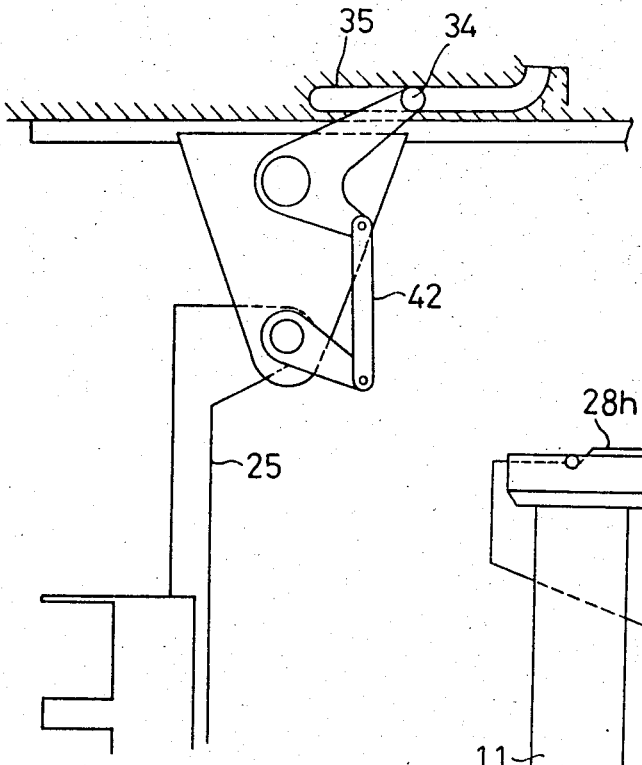
FIG. 15 is a plan view showing another embodiment of a guide means for restricting the arm movement.

Instead of integrally providing the arm 25 with a lever 25*c* and directly mounting a guide roller on the top end of the lever as shown in FIGS. 6 and 9, a regulating means in which a four-joint linkage 42 is formed to transmit the restraining action between the guide roller 34 and the guide groove 35 to the arm 25 may be employed as shown in FIG. 15.

Figure 16:
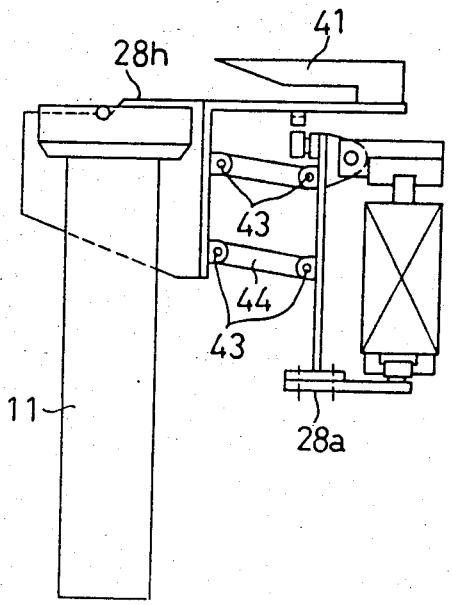
FIG. 16 is a side view showing another embodiment of the mounting mechanism of the hanger section on the main frame.
Figure 17:
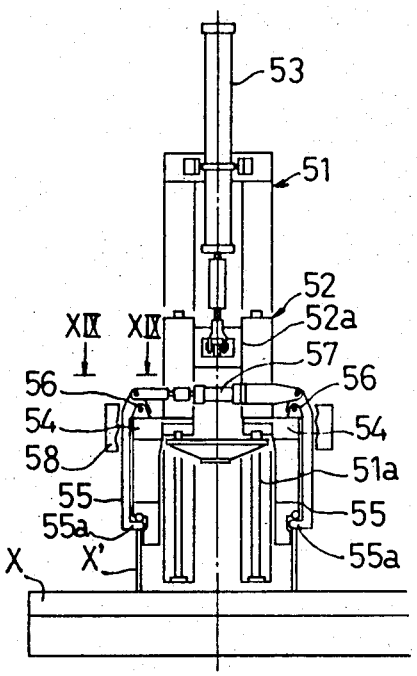
FIG. 17 is a front elevation showing an embodiment of the connecting piece feeder.

Similarly, a parallel linkage 44 using a spherical bushings 43 having two degrees of freedom for each joint as shown in FIG. 16 may be used in place of the mechanism of FIG. 10, which is designed to give said hanger section freedom of movement in the vertical direction and in the axial direction of the arm relative to the main frame.

In the arrangement of the nozzle exchanger of the embodiment, the arm is designed to rotate freely relative to the straight truck 5. The arm 25 is normally held near one side of the truck and rotates only when it closes to a tundish during nozzle exchange to become roughly perpendicular to the truck. Accordingly, at the standby position (the condition shown in FIGS. 5 and 6) with the carriage 22 shifted to the counter-tundish side, the nozzle exchanger has a very small area of projection and does not hinder the casting operation. Further because the nozzle exchanger is of an extremely simple construction and is designed to be operated with few actuators, it can be offered at a low price. Further, maintenance of the same is easy with few troubles.

Next, an embodiment of connecting piece feeder 9 will be explained in concrete terms with reference to FIGS. 17 through 20.

On the front of a base 51 on the truck 5, a pair of parallel guides 51*a* are provided. A vertical section 52*a* of an inverted-L-shaped carriage 52 is slidably mounted on the guides 51*a*. A cylinder 53 is provided having one end connected to the base 51, and the other end to the carriage 52. The cylinder moves the carriage 52 along the guides 51*a* of the base 51 vertically in the directions of the arrows a.

On the top of a projection 52*b* of the carriage 52, a pair of guides 52*c* are provided in parallel. On the guides 52*c*, inverted-L-shaped clamp trucks 54 are slidably mounted to oppose each other.

On the horizontal sections 54*a* of the clamp trucks 54, brackets 56 are provided. A pair of clamps 55 are rotatably mounted on the brackets 56. The bottom ends 55*a* of the arms extending downwardly from the clamps 55 are shaped to hold the upper grips x' of a connecting piece x. Further, the top ends 55*b* of the clamps 55 are connected with each other by a cylinder 57. With the action of the cylinder 57, the bottom ends 55*a* of the clamps 55 are turned in the directions of the arrows c. The upper grips x' of the connecting piece x, therefore, can be freely held by the closing in of the clamps 55 and released by the retreating of the clamps.

When the carriage 52 is in the raised position, the sliding motion of the clamp trucks 54 is regulated and guided by upper guides 58 fixed on the base 51. When the connecting piece x is close to the top end of the mould, the clamp trucks are set free from the regulation and guidance of the upper guides 58. Accordingly, the clamp trucks 54 can individually slide on the respective guides 52*c*. As a result, the connecting piece x is allowed to rotate or swing a little about a vertical axis as shown by the arrows d.

Figure 18:
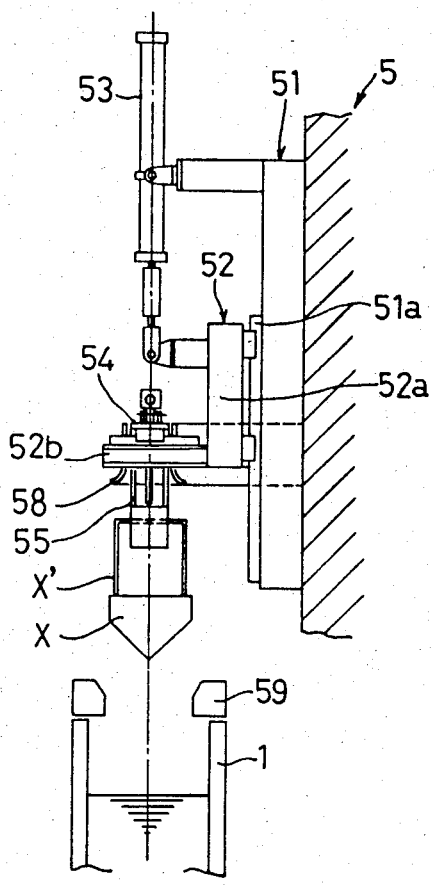
FIG. 18 is a side view of the embodiment of the connecting piece feeder.
Figure 19:
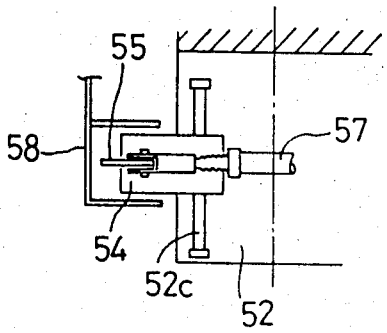
FIG. 19 is a sectional view taken along the line XIX—XIX of FIG. 17.
Figure 20:
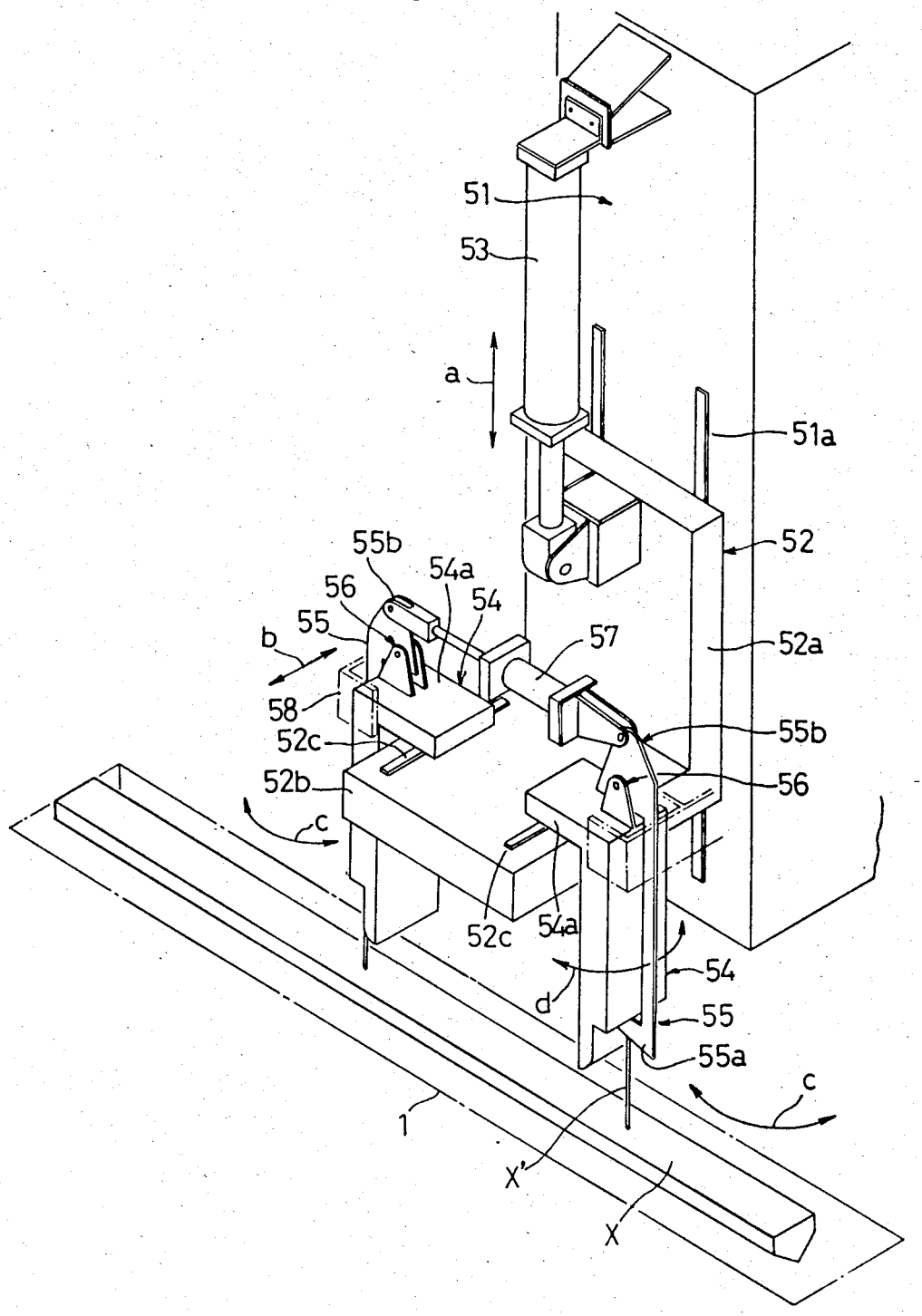
FIG. 20 is a perspective view showing another embodiment for the connecting piece feeder.

Further, as shown in FIG. 18, on the top end of the mould 1, an aligning guide 59 is mounted. The aligning guide 59 is capable of positioning the connecting piece x during its descent.

With the use of the feeder of the present invention, when a connecting piece x is fed into a mould, the clamp trucks 54, and accordingly, the connecting piece x move along the aligning guide mounted on the top end of the mould. As this achieves automatic alignment, and allows mechanical feed of the connecting piece into the specified position in the mould, manual operation with its attendant risks can be eliminated.

Next, a two-strand slab sequential continuous casting method using different types of molten steel will be explained below in detail.

Figure 21:
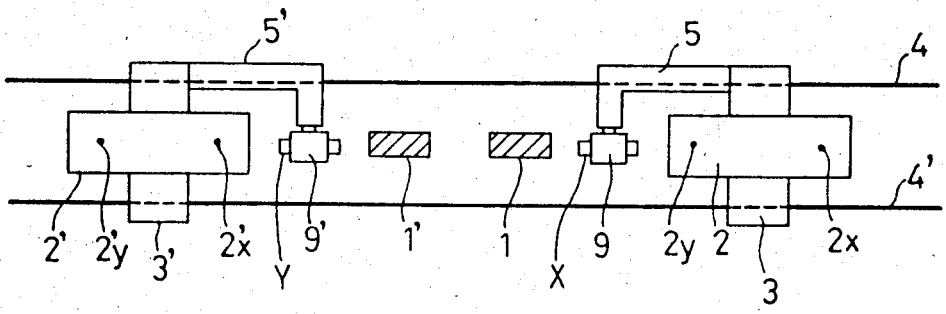
FIG. 21 is the schematic plan view showing two-strand slab continuous casting facility prior to the commencement of operation.

FIG. 21 is a schematic plan view showing the positioning of the apparatus prior to the commencement of the operation. 1 and 1' indicate moulds. Tundish cars 3 and 3' are on standby at both side standby positions with the moulds 1 and 1' therebetween. The tundish cars 3 and 3' are self-movably mounted on the common rails 4. Tundishes 2 and 2', which can feed the moulds 1 and 1' simultaneously, are mounted on the respective tundish cars 3 and 3'. The tundishes 2 and 2' are provided with molten steel outlets 2*x* and 2*y* and 2'*x* and 2'*y* corresponding to the positions of the two moulds 1 and 1', respectively. Each outlet is provided with a sliding nozzle (not illustrated).

Further, on the counter-operator side of the tundish cars 3 and 3', trucks 5 and 5' being loaded with the connecting piece feeders 9 and 9' are connected to opposing faces of the two cars, respectively.

Figure 22A:
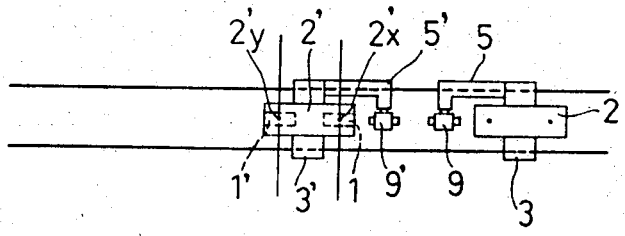
FIG. 22 (*a*)–(*c*) are a schematic plan views showing stages of continuous casting of slabs of different steel types.
Figure 22B:
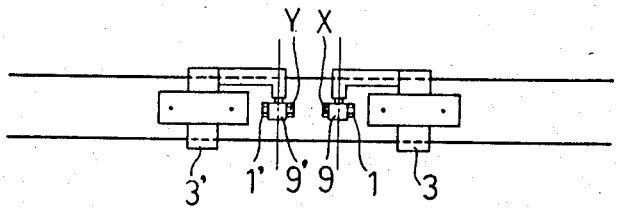
Figure 22C:
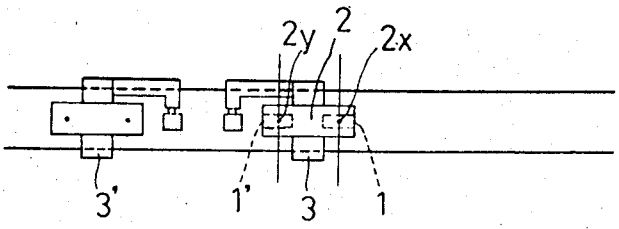

FIGS. 22*a*–*c* are schematic plan views showing stages of sequential continuous casting of slabs from different types or grades of molten steel.

The tundish car 3' on the left travels from the standby position of FIG. 21 to a position above the moulds 1 and 1'. Just when the first molten steel is poured from a ladle (not illustrated) above the tundish car 3' into the tundish 2', the molten steel outlets 2'*x* and 2'*y* are opened to pour the molten steel into the moulds 1 and 1'. During operation, the tundish car 3 on the right is on standby at a preheating position (FIG. 22(*a*)). Under this condition, when the pouring of the first molten steel into the moulds is over, the withdrawal of the slab is stopped.

Next, as shown in FIG. 22(*b*), the tundish car 3' on the left travels towards the left, and its connecting piece feeder 9' is placed just above the left mould 1'. The tundish car 3 on the right also travels and its connecting piece feeder 9 is place just above the right mould 1. Under this condition, each of the feeders 9 and 9' is operated to feed slab connecting pieces x and y onto the solidifying shells in the moulds to fix them in the shells simultaneously.

Next, as shown in FIG. 22(*c*), the tundish car 3' on the left travels to the left standby position, and at the same time, the tundish car 3 on the right travels further to the left to bring the molten steel outlets 2*x* and 2*y* of its tundish 2 right above the moulds 1 and 1'. Under this condition, the second molten steel is poured from a ladle above the tundish car 3 into the tundish 2, and the molten steel outlets 2*x* and 2*y* are opened to pour the second molten steel into the vicinities of connecting pieces x and y in the moulds 1 and 1'. Then, the withdrawal of the slab, which was stopped before, is resumed to achieve continuous casting. This method allows quick and safe sequential continuous casting of different types of grades of molten steel, bearing satisfactory results.

The explanation here is limited to the feeding operation of slab connecting pieces for changing the type or grade of molten steel. As mentioned above, in addition to the feeding operation, operations such as exchange of immersion nozzles and feeding of powder can also be conducted.

It is readily apparent that the above-described Labour Saving Apparatus for Continuous Casting Facility meets all of the objects mentioned above and also has the advantage of wide commercial utility. It should be understood that the specific form of the invention hereinabove described is intended to be representative only, as certain modifications within the scope of these teaches will be apparent to those skilled in the art.

Accordingly, reference should be made to the following claims in determining the full scope of the invention.

What is claimed is:

1. In a continuous casting facility, a labor-saving apparatus, said facility including a plurality of casting moulds having an operator's side and a counter-operator's side opposite to the operator's side, a pair of rails, one of the pair of rails on each of the sides of the moulds, self-propelled tundish cars riding on the rails and each having a tundish, each tundish having a lower face, an immersion nozzle, and means for detachably mounting said immersion nozzle on the lower face; the apparatus comprising:

a plurality of trucks each running on the rail on the counter-operator's side and connectable to one of the tundish cars, and means mounted on each said truck for exchanging immersion nozzles of the tundish mounted on said one of the tundish cars.

2. The apparatus of claim 1, further including a connecting piece feeder means mounted on each said truck for feeding a connecting piece to one of the moulds.

3. The apparatus of claim 2, further including a powder feeder means mounted on each said truck for feeding powder to one of the moulds during casting.

4. The apparatus of claim 2, further including an immersion nozzle preheater mounted on each said truck.

5. The apparatus of claim 2, wherein the moulds are arranged in pairs, each tundish car being associated with one of the moulds, the two tundish cars associated with each pair of moulds having opposed faces, and each said connecting piece feeder means is positioned adjacent the opposed face of the tundish car with which the truck carrying the connecting piece feeder means is connected.

6. The apparatus of claim 2, wherein each connecting piece feeder means comprises a base mounted on said truck, first guides on said base, a carriage vertically movable on said first guides, means for vertically moving said carriage on said first guides, second guides on said carriage, a pair of clamp trucks slidably mounted on said second guides, a pair of clamps, each rotatably pivoted on one of said pair of clamp trucks, each having a top end and a bottom end, and means connected to said top ends for moving said bottom ends for clamping and releasing connecting piece holders.

7. The apparatus of claim 1, further including a powder feeder means mounted on each said truck for feeding powder to one of the moulds during casting.

8. The apparatus of claim 1, further including an immersion nozzle preheater mounted on each said truck.

9. The apparatus of claim 1, wherein each immersion nozzle exchanging means comprises a carriage longitudinally movably mounted on said truck, means for moving said carriage lontitudinally on said truck, an axle rotatably mounted on said carriage having a top end, an arm connected to said axle, a hand section mounted on said arm, said hand section including an immersion nozzle receiving/delivering hanger, motor means on said hanger for mounting/dismounting said nozzle, a lever mounted on said top end of said axle and rotatable therewith, a guide roller mounted on said lever, and a guide provided on said truck with which said guide roller engages so that said arm can make specified rotating and traveling movements upon movement of said carriage on said truck.

10. The apparatus of claim 9, wherein said lower face immersion nozzle mounting means wherein has a positioning guide associated therewith and guide pins fittable in said positioning guide are provided on the hand section of the associated immersion nozzle exchanging means.

* * * * *